US005788517A

United States Patent [19]

Elmouchi

[11] Patent Number: 5,788,517

[45] Date of Patent: Aug. 4, 1998

[54] CORDLESS EXTENSION SYSTEM

[76] Inventor: Daniel Elmouchi, 1555 Mesa Verde Dr. E., Suite 43—C, Costa Mesa, Calif. 92626

[21] Appl. No.: 740,476

[22] Filed: Oct. 30, 1996

Related U.S. Application Data

[63] Continuation of Ser. No. 381,357, Jan. 31, 1995, Pat. No. 5,603,621.

[51] Int. Cl.[6] ..... H01R 25/00

[52] U.S. Cl. ..... 439/120; 439/148; 439/119

[58] Field of Search ..... 439/110, 113–115, 439/117, 119–121, 638, 651, 652, 654, 655, 148

[56] References Cited

U.S. PATENT DOCUMENTS

| | | | |
|---|---|---|---|
| 4,278,834 | 7/1981 | Boundy | 439/148 |
| 4,801,271 | 1/1989 | Piper | 439/148 |
| 5,096,430 | 3/1992 | D'Amico | 439/148 |
| 5,306,165 | 4/1994 | Nadeau | 439/120 |
| 5,418,328 | 5/1995 | Nadeau | 439/120 |

*Primary Examiner*—J. J. Swann

*Attorney, Agent, or Firm*—Walter A. Hackler

[57] ABSTRACT

A cordless extension system generally includes an adaptor that enables manual electrical coupling between a conductive strip and a conventional duplex wall outlet when the adaptor is positioned over a face of the outlet. Removable outlet members are provided for selective placement along the conductive strip and are adapted for engagement with a conventional pronged plug. The cordless extension system may also provide strip connectors and strip safety guards.

14 Claims, 4 Drawing Sheets

20
5
110
112
106
122
120
42
124
44
40
12
14
104
104
5
50

20
128
126
126
122
120
124

CORDLESS EXTENSION SYSTEM

This is a continuation of U.S. patent application Ser No. 08/381,357, filed on Jan 31, 1995, now U.S. Pat No. 5,603,621.

The present invention generally relates to electrical outlets and more particularly to track systems and extensions for electrical wall outlets.

Wall outlets provide access to the electrical service in a building. During the life of a structure the distribution of wall outlets typically remains unchanged from when outlets were first installed during the building's construction.

Many older structures, built during times of low dependency upon electrical appliances, frequently contain an insufficient number of outlets to suit the needs of a modern family. Even in modern structures that contain a large number of wall outlets, the outlets may not be conveniently located. For example, a person may need to conquer the physical task of crawling under a bed in order to reach a wall outlet, before he is able to vacuum a bedroom. For an elderly or disabled person, the task of plugging and unplugging the vacuum cleaner into an inconvenient wall outlet may be the most difficult and tiring part of the vacuuming chore.

If a resident chooses to change the distribution or increase the number of electrical outlets in his home, he can utilize a commercially available track system, or he can add new wall outlets to an existing circuit.

The present invention is directed to simplifying the installation of track systems, for example a track system in which a series of individual movable outlets is connected to a wall mounted track. The installation of a conventional track system requires physical access to a electrical housing box in a wall's interior, in order to "hard wire" the track system to the electrical service. Thus the task presents the danger of electrical shock if not properly performed.

Local ordinances may require that a homeowner obtain a permit before he perform any electrical wiring work such as the installation of a track system or addition of new wall outlets. Such safety ordinances may even prohibit the homeowner from performing such work altogether. The seemingly simple task of adding outlets requires knowledge of the circuitry of the particular building and more importantly, sufficient knowledge of proper wiring and safety. Thus, most authorities on the subject recommend that the homeowner utilize the services of a professional electrician to complete any home wiring project, due to the potentially deadly risks presented by improper electrical wiring work.

The expense of hiring a professional typically forces the homeowner to the use of flexible extension cords to solve the problem of inadequate wall outlets. The use of an extension cord merely requires the steps of inserting the extension cord prongs into the remote wall outlet, extending the cord such that the cord receptacle is at an accessible location, and plugging an appliance into the cord's receptacle. However, principles of safety dictate that appliances should be connected as close to the wall outlet as possible, not connected via a long cord traversing the length of a room. A tangle of electrical cords is not only unsightly, it is a potentially dangerous situation as it may present an obstacle to foot travel. A person may trip on the cable and bring a hot appliance crashing to the floor. Furthermore, cords are often an attraction to small children, who may pull on them, or attempt to disconnect them. Understandably, the use of extension cords is often strictly regulated by safety ordinances, such as local fire codes, which usually prohibit one from connecting more than one appliance to the end of a single cord.

What is needed is a device that offers improved access to electrical wall outlets without the need for extension cords. The present invention enables a person, such as a homeowner, to easily add new outlets to his home without exposure to the dangers of electrical shock and without the need for professional assistance. The present invention also enables a person with little or no knowledge of electrical wiring techniques to install, for example, an attractive track lighting system in his home.

SUMMARY OF THE INVENTION

Accordingly, the present invention provides a device and method for improving access to electrical wall outlets and simplifying the installation of track systems. More particularly, the present invention provides an adaptor that enables manual electrical coupling of a conventional outlet receptacle with a conductive strip by a simple snap engagement that requires no wiring or use of cords.

Preferably, the strip is positioned along a wall such that it overlays one of the receptacles on the conventional duplex outlet, without electrical contact with the outlet, leaving the other receptacle exposed. The adaptor includes prongs encased within, which provide means for electrical coupling between the exposed receptacle and the strip.

More particularly, two sets of prongs are provided and are adapted such that when the first set is manually inserted in the exposed receptacle, the second set nearly simultaneously electrically connects with the conductive tracks. Thus, the design of the present invention enables one to create a track system by merely mounting a conductive strip on a wall and plugging an adaptor, in accordance with the present invention, into an standard electrical outlet.

Importantly, at least one outlet member, adapted for removable attachment to the strip, may be provided. Prongs on the outlet member may provide means for causing electrical contact between the parallel conductive tracks running along the strip and the outlet member. Thus, once the adaptor has been plugged into place, the removably attached outlet will be in electrical contact with the wall outlet via the conductive tracks. This enables a person such as a homeowner, to position a outlet member at any point along the strip, thus substantially improving his access to a receptacle. The outlet member may be adapted for insertion of a standard pronged plug such as on an appliance, or may include, for example, a threaded socket for attachment of a standard light bulb.

Preferably, the adaptor of the present invention is configured such that it engages a face plate on a standard duplex wall outlet. By the installation of a screw through the center of the case, the adaptor can be secured to the wall along with the conductive strip in order to create a permanent track fixture.

One embodiment of the present invention provides a plurality of strips of various lengths. Strip connectors may be provided which enable connection between two or more strips. The connectors are designed such that the strips may be quickly snapped together, causing respective conductive tracks to contact each other. The connectors further include means to enable the positioning of strips in linear or angular configurations.

DETAILED DESCRIPTION

Figure 1:
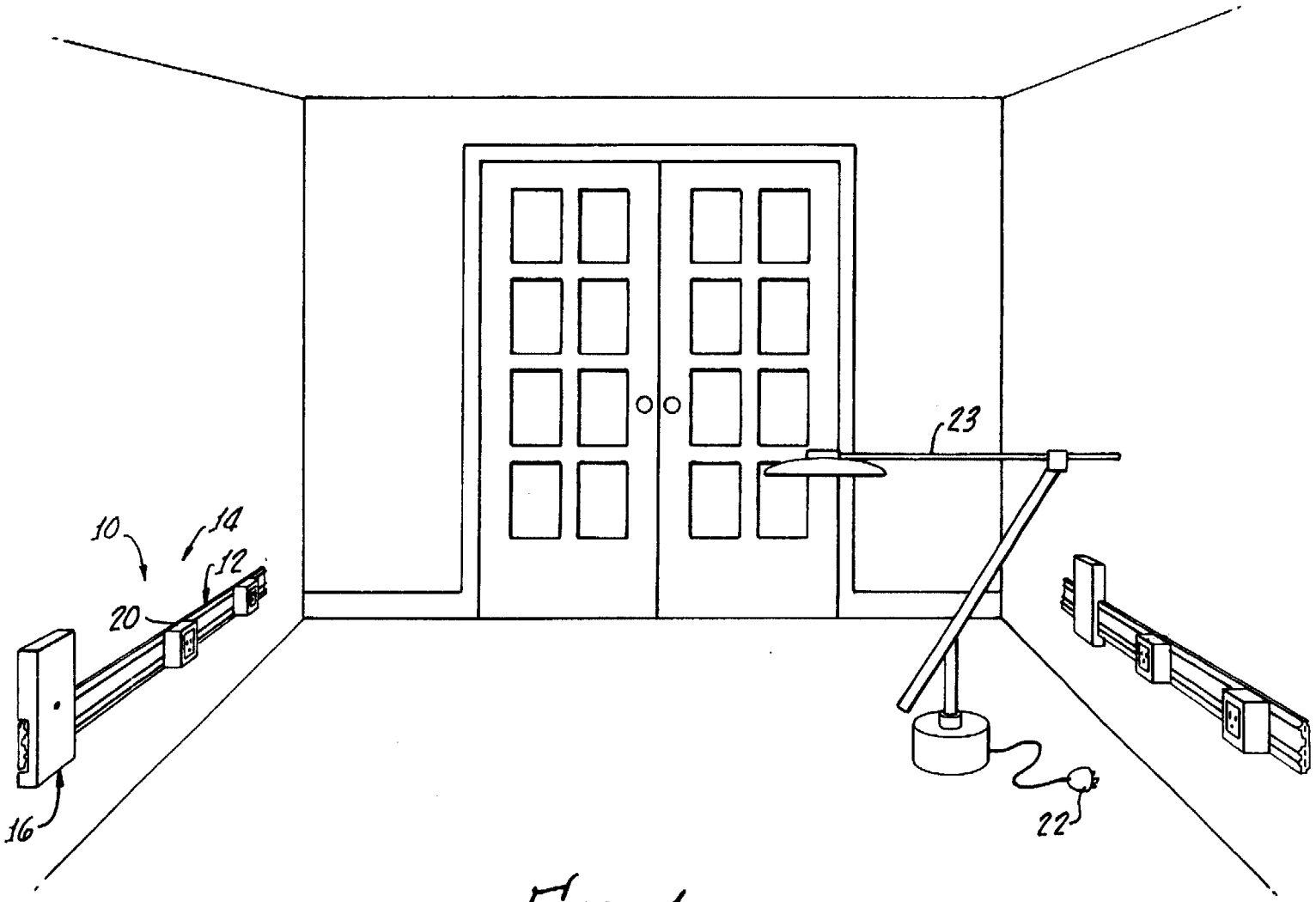
FIG. 1 shows an embodiment of the present invention, including an adaptor in accordance with the present invention, a conductive strip and several removable outlets, as installed on two walls of a room or office.

Turning now to FIG. 1, a cordless extension system 10 includes generally at least one strip 12 that may be easily mounted to a wall 14 and an adaptor 16 for causing an electrical connection between the strip 12 and a conventional electrical outlet (beneath the adaptor 16, and therefore not shown in FIG. 1). Further included is at least one outlet member 20 adapted for positioning along the strip 12 and adapted for engagement with, for example, a pronged plug 22 of a light fixture 23. Importantly, the adaptor 16 enables an electrical connection between the strip 12 and the wall outlet by means of a one-step, "snap together" connection.

Figure 2:
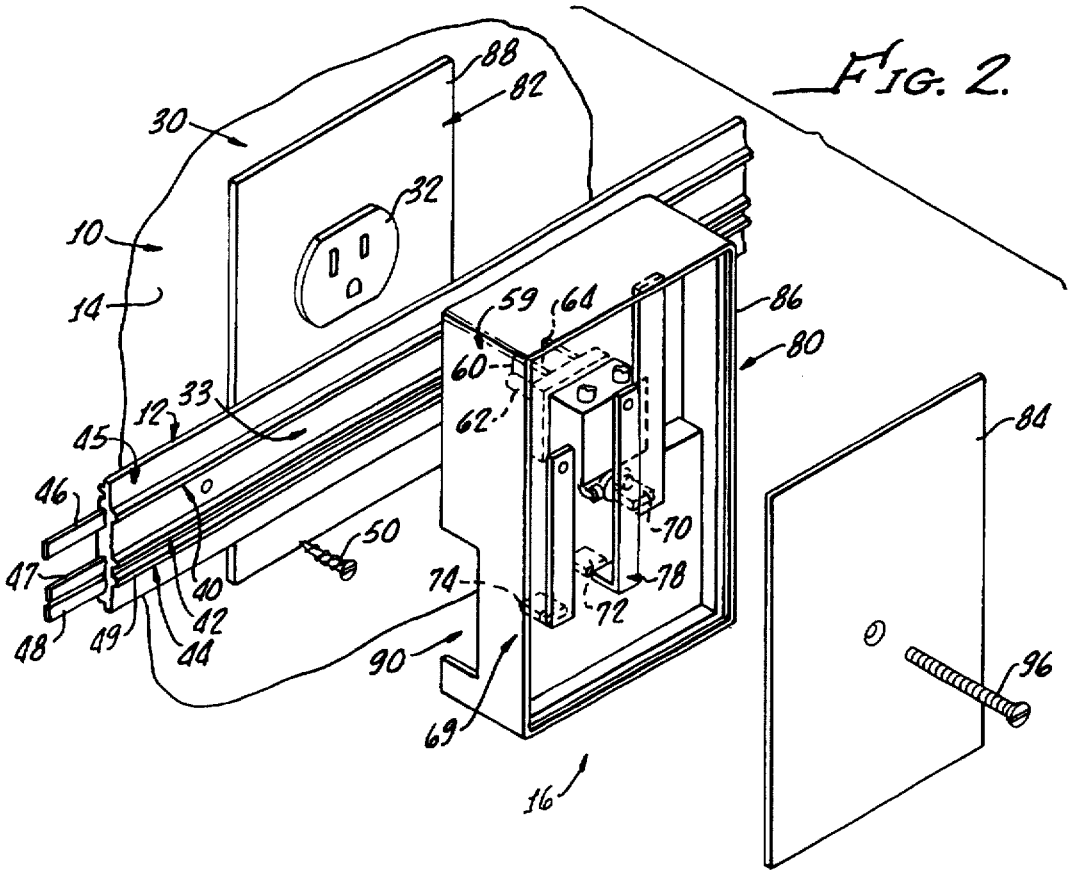
FIG. 2 shows an exploded view of the adaptor and the strip shown in FIG. 1.

FIG. 2 shows an exploded perspective of the present invention 10 and its relationship to a conventional duplex electrical outlet 30. A conventional duplex outlet 30 has a first 32 and a second receptacle (not shown designed for insertion of a conventional pronged plug 22. Shown is a portion 33 of the strip 12 positioned over the second receptacle.

Figure 3:
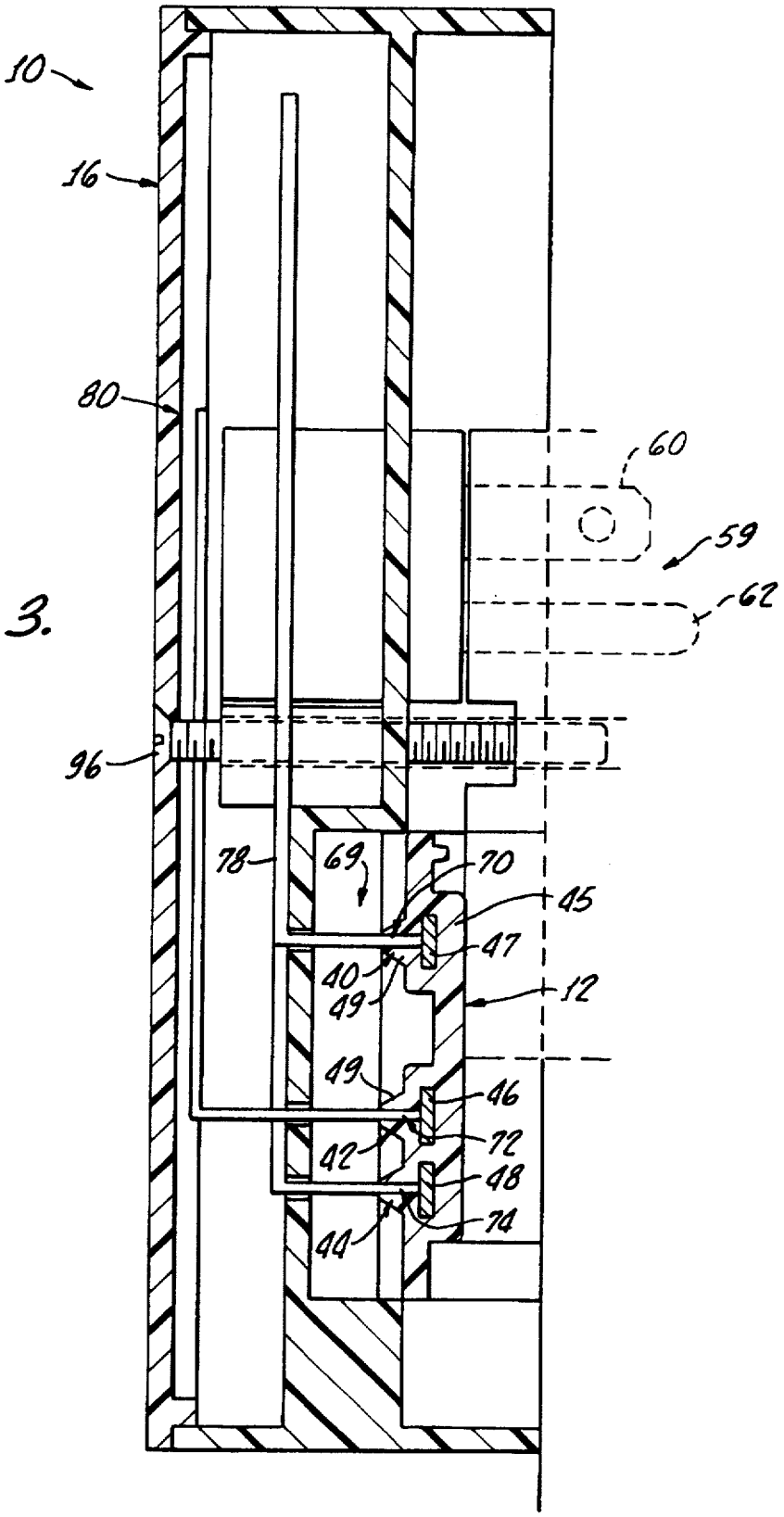
FIG. 3 shows a cross sectional view of the adaptor and the conductive strip shown in FIG. 1.

Referring now to both FIGS. 2 and 3,the strip 12 includes a plurality of parallel, electrically conductive tracks 40,42, 44 running along its length and nay include a nonconductive portion 45, made of any suitable material, for example a flexible plastic. The parallel tracks 40, 42,44 may comprise narrow strips 46, 47, 48, made of any suitable electrically conductive material, such as a copper alloy, embedded in the nonconductive portion 45. Preferably, ledges 49, rising adjacent each conductive track 40, 42, 44, are included as a safety measure, in order to insulate a user from any direct contact with the strips 46, 47, 48. The strip 12 preferably has a width sufficient to substantially or completely cover the second receptacle.

Once the strip 12 is mounted to the wall 14, by means of screws 50 or the like, the adaptor 16 may be manually placed over the duplex outlet 30 and connected thereto. As will be more thoroughly explained hereinafter, by proper positioning of the adaptor 16, a user will cause an electrical connection between the first receptacle 32 and the parallel conductive tracks 40, 42, 44. Notably, the there is no electrical connection between the covered second receptacle and the strip 12.

In particular, a first Set 59 of prongs 60, 62, 64 and a second set 69 of prongs 70, 72, 74 may provide means for removably coupling the adaptor 16 with the first receptacle 32 and the conductive tracks 40, 42, 44. More particularly, prongs 60, 62, 64, which are adapted for insertion onto a conventional duplex outlet receptacle, may be in communication with prongs 70, 72, 74, which are adapted for engagement with respective parallel conductive tracks 40, 42, 44. Internal connectors 78 may be used to establish an electrically conductive path between respective prongs, for example between prong 62 and prong 72 which both establish a ground connection. The internal connection may be organized in any conventional manner, for example a bus arrangement (not shown for the sake of clarity).

The adaptor 16 includes a cover 80 which encases the prongs 60, 62, 64, 70, 72, 74 and provides means for enabling manual insertion of said prongs into first receptacle 32 and into the conductive tracks 40, 42 44. Preferably, the cover 80 is configured to completely enclose the face 82 of the conventional duplex outlet. The cover 80 may be configured for engagement with a face plate 88 of the conventional duplex outlet 30 when the strip 12 overlays the second receptacle and leaves the first receptacle 32 exposed. Alternatively, the face plate 88 may be removed prior to placement of the adaptor 16.

The cover 80 may include a top plate 84, and a base 86, the base being contoured such that it provides allowance for placement of the strip 12. For example, the base 86 may include notches 90 for clamping over the strip 12. Thus, once the strip 12 is mounted in place over the second receptacle, a user of the device 10 may quickly cause an electrical connection by properly positioning and subsequently "plugging" the adaptor 16, into the duplex. outlet 30 modified by the overlying strip 12.

Preferably, the adaptor 16 enables simultaneous connection of the first set of prongs 60, 62, 64 with the first receptacle and the second set of prongs 70, 72, 74 with the parallel conductive tracks 40, 42, 44, FIG. 3. shows a cross-sectional view of the adaptor 16 in engagement with the strip 12. Particularly prongs 62 and 72, which establish a ground connection between the electrical service and the device 10, are inserted simultaneously into the first receptacle and parallel conductive track 42 . This safety feature may be accomplished by making the ground prongs 62, 72 longer than the remaining prongs 60, 64, 70, and 74. In effect, however, the adaptor 16 enables all prongs 60, 62, 64, 70, 72, 74 to be inserted simultaneously to establish an immediate connection between the first receptacle 32 and the parallel conductive tracks 40, 42, 44, it is again emphasized that the manual process of establishing the electrical connection between the tracks 40, 42, 44 and the first receptacle 32 involves merely one step of inserting the adaptor 16 into the wall outlet 30 modified by the overlying strip 12.

Once the adaptor 16 has been placed properly over the conventional outlet, the adaptor 16 may be more securely fixed to the wall by means of a single screw 96 or the like, such that the system 10 becomes a permanent fixture in room. Notably, a screw 96 or other like fastening device is not required for proper functioning of the extension system 10. A user may choose to omit the screw 96 in order to enable the easy removal of the adaptor. For example, he may remove the adaptor from the wall as a simple way of disconnecting the power being supplied to any appliances or light fixtures along the strip 12.

Figure 4:
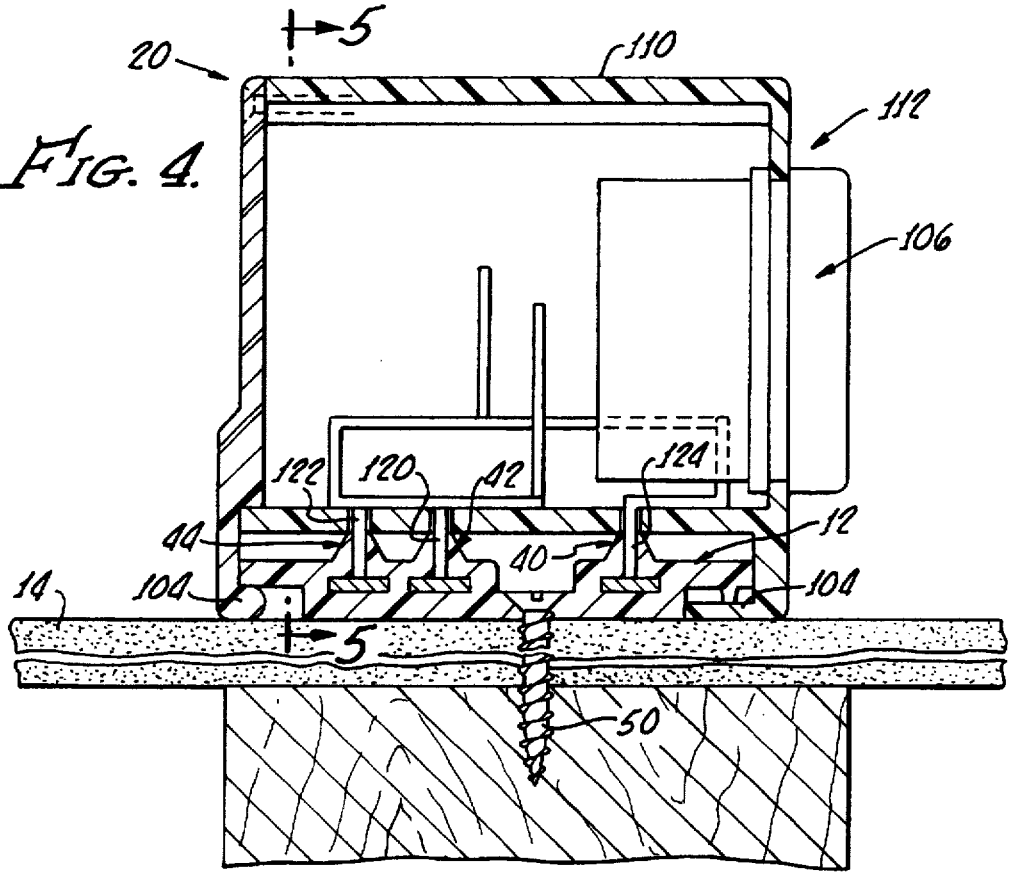
FIG. 4 shows a cross sectional view of a removable outlet engaged with a portion of the conductive strip, as shown in FIG. 1.

Turning now to FIG. 4, an outlet member 20, adapted for engagement and selective placement along the strip 12, is shown in cross-section. The outlet member 20 is shown engaged to strip 12 that is mounted to a Wall 14 by means of a screw 50. The outlet member 20 is preferably adapted for removable engagement with the strip 12 by means of a lip 104. The outlet member 20 includes a receptacle 106 shown in phantom line, for insertion of a conventional pronged plug (not shown). It should be appreciated that the outlet member 20 may alternatively include other types of receptacles, such as for example, a threaded socket (not shown) configured for engagement with a conventional light bulb. Furthermore, the receptacle 106 may be positioned on a front face 110 of the member 20, parallel with the wall 14, or one of several side faces 112, as shown. Thus, various outlet members may be made available, in order to suit particular needs of different users of the system 10.

The outlet member 20 preferably includes prongs 120, 122, 124, which provide means for causing electrical connection between the outlet member and the parallel conductive tracks. Notably, the prongs 120, 122, 124 may be identical in structure and arrangement to the second set of prongs 70, 72, 74 of the adaptor 16 since both the adaptor 16 and the member 20 are intended to engage with the strip 12 and contact the conductive tracks 40, 42, 44.

Figure 5:
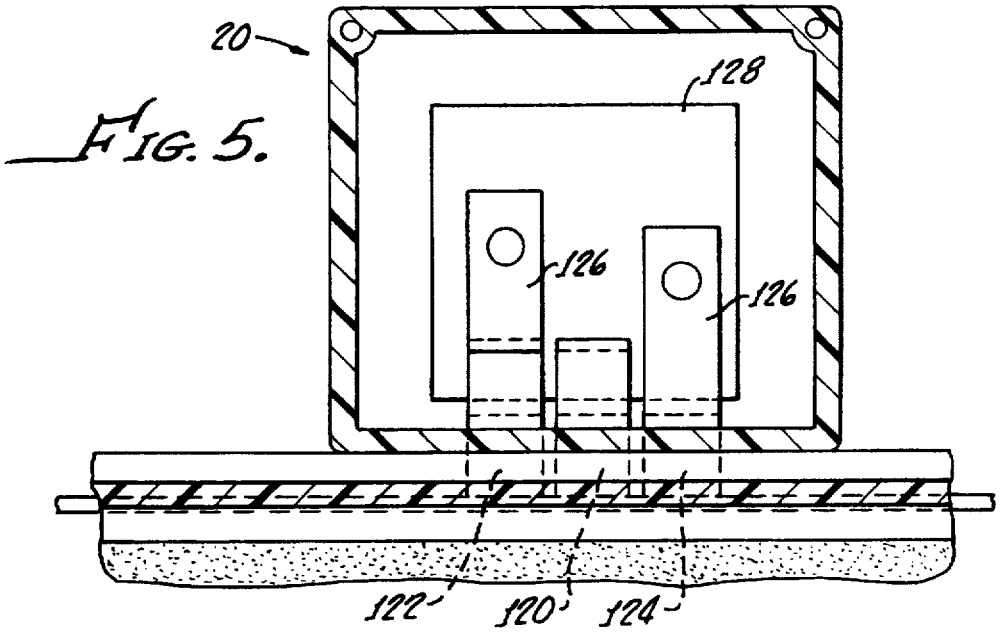
FIG. 5 shows a cross-sectional view of the removable outlet taken along line 5—5 of FIG. 4.

FIG. 5 shows a cross-sectional view of the outlet member of FIG. 4 taken along line 5—5. Shown are internal connectors 126 joined to a bus bar for causing electrical connection between the prongs 120, 122, 124 and for example, an appliance plug (not shown) that may be inserted into the outlet member 20.

Figure 6:
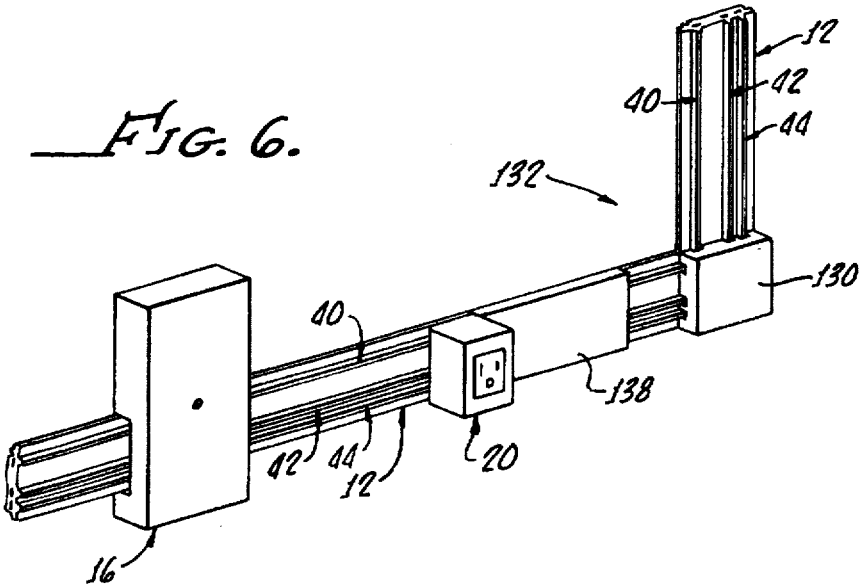
FIG. 6 shows an embodiment of the present invention including a strip guard and a strip connector.

FIG. 6 shows a feature of the present invention 10 which includes a plurality of strips 12 and enables coupling of the strips 12. In particular, a connector 130 enables individual strips 12 to be joined to each other in a linear or angular configuration 132. The connector 130 includes means to cause electrical contact between respective parallel conductive tracks 40, 42, 44. This may be accomplished through the use of any suitable mechanism, for example conductive wiring within the connector (not shown) arranged to provide a conduit between respective tracks, or a mechanism similar to the connection between the outlet member 20 and the tracks 40, 42, 44 as described with reference to FIG. 4.

Another feature of the present invention, also shown in FIG. 6, is a guard 138. The guard is preferably a plastic member configured for removable engagement with the strip. Primarily, the guard provides means for protecting exposed portions of the strip, such as portions extending between outlet members 20, as well as protecting against direct user contact with the conductive tracks 40, 42, 44.

Although there has been hereinabove described a particular arrangement of a cordless extension system in accordance with the present invention,for the purpose of illustrating the manner in which the invention may be used to advantage, it should be appreciated that the invention is not limited thereto. Accordingly, any and all modifications, variations or equivalent arrangements which may occur to those skilled in the art, should be considered to be within the scope of the present invention as defined in the appended claims.

What is claimed is:

1. A cordless extension system for use with a conventional electrical outlet having two adjacent receptacles, said system comprising:

at least one strip having a plurality of parallel continuous electrically conductive tracks therein;

means for mounting the strip in a position on a wall in order that any portion of the strip substantially covers a first of the two adjacent receptacles without electrical contact between the strip and the covered receptacle;

adaptor means for simultaneously plugging said strip into a second of the two adjacent receptacles in order to cause electrical contact between the strip and the second receptacle, said adaptor means comprising two spaced apart and adjacently disposed sets of prongs, a first set sized for insertion into the tracks and a second set sized for insertion into the second receptacle, said adaptor means further comprising a base having cutout means, spaced apart from the second set of prongs, for enabling placement of the adaptor means over the strip with the first set of prongs engaging said track and the second set of prongs engaging the second receptacle, and further enabling the adaptor means to be removed from the strip and outlet without removing the strip from the wall.

2. The cordless extension system according to claim 1 wherein the strip has sufficient width to substantially cover the first receptacle.

3. The cordless extension system according to claim 2 wherein the adaptor means further comprises cover means for engaging a face plate of the conventional electrical outlet when the strip covers the first receptacle.

4. The cordless extension system according to claim 1 further comprising an outlet member including means for enabling removable engagement and placement of the outlet member anywhere along the strip said outlet member further including means for receiving a conventional pronged plug.

5. The cordless extension system according to claim 1 including a plurality of strips.

6. The cordless extension system according to claim 5 further comprising strip connector means for enabling engagement of one or said strips with another of said strips and for causing contact between respective parallel conductive tracks.

7. The cordless extension system according to claim 1 further comprising guard means, removably attached to the strip, for protecting exposed portions of the strip.

8. A cordless extension system for use with a conventional electrical outlet having two adjacent receptacles, said system comprising:

at least one strip having a face and a plurality of parallel, continuous, electrically conductive tracks within the face;

means for mounting the strip in a position on a wall in order that any portion of the strip substantially covers a first of the two adjacent receptacles without electrical contact between the strip and the first receptacle;

adaptor means, including two adjacently disposed sets of prongs, for causing electrical contact between the electrically conductive tracks and a second of the two adjacent receptacles by plugging said adaptor means into the face of the strip and the second receptacle such that the prongs are disposed perpendicularly with respect to the electrically conductive tracks, said adaptor means further comprising a base having cutout means, aligned with a first set of the prongs and spaced apart from a second set of the prongs, for enabling placement of the adaptor means over the strip and for further enabling the adaptor means to be removed from the strip and outlet without removing the strip from the wall.

9. The cordless extension system according to claim 8 wherein the adaptor means further includes cover means for engaging a face plate of the conventional electrical outlet when the strip covers the first receptacle.

10. The cordless extension system according to claim 9 further comprising an outlet member including means for enabling removable engagement and placement of the outlet member anywhere along the face of the strip, said outlet member further including means for receiving a conventional pronged plug.

11. The cordless extension system according to claim 10 including a plurality of strips.

12. The cordless extension system according to claim 11 further comprising strip connector means for enabling engagement of one of said strips with another or said strips and for causing contact between respective conductive tracks.

13. The cordless extension system according to claim 11 further comprising guard means, removably attached to the strip, for protecting exposed portions of the strip.

14. A cordless extension system for use with a conventional electrical outlet having two adjacent receptacles, said system comprising:

at least one strip, having a face and a plurality of parallel continuous electrically conductive tracks in the face, said strip having a width sufficient to cover one of the two adjacent receptacles;

means for mounting the strip to a wall and across the conventional electrical outlet such that the strip substantially covers a first of the two adjacent receptacles;

adaptor means, including two adjacently disposed sets of prongs, cover means for engaging a face plate of the conventional electrical outlet when the strip substantially covers the first receptacle, said adaptor means for causing electrical contact between the electrically conductive tracks and a second of the two adjacent receptacles by plugging said adaptor means into the face of the strip and the second receptacle such that the prongs are disposed perpendicularly with respect to the electrically conductive tracks, said sets of prongs including a first set of prongs sized for insertion into the tracks and a second set sized for insertion into the second receptacle, and a base having cutout means, aligned with a first set of the prongs and spaced apart from a second set of the prongs, for enabling placement of the adaptor means over the strip and for further enabling the adaptor means to be removed from the strip and outlet without removing the strip from the wall; and an outlet member including means for enabling removable engagement and placement of the outlet member anywhere along the face of the trip said outlet member further including means for receiving a conventional pronged plug.

* * * * *